US006457510B1

(12) United States Patent
van Heerveld

(10) Patent No.: US 6,457,510 B1
(45) Date of Patent: Oct. 1, 2002

(54) METHOD FOR COMPACTING MOULDING SAND

(75) Inventor: Daniel Jacobus Petrus van Heerveld, Eindhoven (NL)

(73) Assignee: Vulcan Engineering Company, Inc., Helena, AL (US)

( * ) Notice: Subject to any disclaimer, the term of this patent is extended or adjusted under 35 U.S.C. 154(b) by 0 days.

(21) Appl. No.: 09/486,518

(22) PCT Filed: Sep. 1, 1998

(86) PCT No.: PCT/NL98/00492

§ 371 (c)(1),
(2), (4) Date: May 25, 2000

(87) PCT Pub. No.: WO99/11402

PCT Pub. Date: Mar. 11, 1999

(30) Foreign Application Priority Data

Sep. 1, 1997 (NL) ..... 1006903

(51) Int. Cl.[7] ..... B22C 15/10

(52) U.S. Cl. ..... 164/39; 164/203; 366/114; 366/128

(58) Field of Search ..... 164/203, 37, 39, 164/40, 169, 187, 223, 260, 34; 366/114, 116, 128

(56) References Cited

U.S. PATENT DOCUMENTS

| | | | | | |
|---|---|---|---|---|---|
| 4,454,906 | A | * | 6/1984 | Musschoot | 164/34 |
| 4,600,046 | A | * | 7/1986 | Bailey et al. | 164/34 |
| 4,766,771 | A | * | 8/1988 | Bailey et al. | 74/61 |
| 4,784,206 | A | * | 11/1988 | Sauerman et al. | 164/18 |
| 4,850,421 | A | * | 7/1989 | Bailey et al. | 164/203 |
| 4,860,816 | A | * | 8/1989 | Bond | 164/154 |
| 5,067,549 | A | * | 11/1991 | Musschoot | 164/39 |

* cited by examiner

*Primary Examiner*—M. Alexandra Elve
*Assistant Examiner*—Kevin P. Kerns
(74) *Attorney, Agent, or Firm*—Christopher A. Holland; Robert J. Veal; Burr & Forman LLP

(57) ABSTRACT

A method for compacting molding sand in a molding box in which a model is present, which model is embedded in molding sand. The molding box is vibrated by means of imbalance weights, which are each to be rotated about an axis of rotation during operation. At least four imbalance weights being rotatable about parallel axes of rotation are used, which can be shifted in phase relative to each other.

24 Claims, 2 Drawing Sheets

METHOD FOR COMPACTING MOULDING SAND

The invention relates to a method for compacting moulding sand in a moulding box in which a model is present, which model is embedded in moulding sand, wherein the moulding box is vibrated by means of imbalance weights, which are each to be rotated about an axis of rotation during operation.

The term imbalance weight is understood to mean a mass to be rotated about an axis of rotation by means of a suitable driving source, whereby the center of gravity of said mass is located some distance away from the axis of rotation in question.

As is described in U.S. Pat. No. 4,600,046, such a method is used in particular when using foam models, which evaporate when molten metal is poured into the moulding box, whereby the vapors being formed will escape through the compacted moulding sand.

With the construction described in U.S. Pat. No. 4,600,046, the moulding box is supported on a spring-supported platform. A vibrating unit, which comprises two imbalance weights rotating in opposite directions during operation, is connected to the moulding box at a point located some distance above the springing platform. The two imbalance weights rotating in opposite directions generate a horizontally oriented vibration force during operation, which can only be varied in magnitude by increasing the frequency or by shifting the imbalance weights relative to each other during standstill of the device, but as a result of the spring support of the moulding box by means of the springing platform, it will not be possible to prevent the moulding box from making a tumbling movement as well during operation. Furthermore, when the counterweights are rotating, a vibration force only in substantially horizontal direction will constantly be generated.

According to the invention, at least four imbalance weights are used, which can be shifted in phase relative to each other.

When using the method according to the invention, vibration in vertical direction as well as in horizontal direction can be generated as desired, whereby also the magnitude of the vibration force can be varied independently of the frequency of the movement of the imbalance weights. Preferably, this will be done in such a manner that the resulting vibration force will pass through the center of gravity of the moulding box. Furthermore it is possible to arrange that no vibration forces will be exerted on the moulding box when the imbalance weights are rotating, which makes it possible in an advantageous manner to run the imbalance weights up to the desired speed first, and only then produce a vibration force by means of the imbalance weights. It is possible thereby to avoid vibration of the moulding box at a frequency corresponding with the natural vibration frequency of the moulding box during the starting and stopping of the rotation of the imbalance weights, whereby undesirable movements affecting the intended compacting of the moulding sand may occur.

According to another aspect of the invention, a device which is particularly suitable for carrying out the above-described method comprises a frame for supporting a moulding box, whilst the frame supports four imbalance weights which are rotatable about axes of rotation extending parallel to each other, and means are provided for driving the imbalance weights and shifting them in phase relative to each other.

The invention will be explained in more detail with reference to the accompanying figures.

FIGS. 1–9 diagrammatically show various possibilities for rotating and shifting imbalance weights relative to each other when using the method according to the invention.

FIGS. 1–9 diagrammatically show a moulding box 1 to be vibrated, as well as four imbalance weights 2–5. Two imbalance weights 2, 3 are disposed one above the other on one side of moulding box 1, and the two other imbalance weights 4 and 5 are disposed one above the other on the other side of moulding box 1, thus effecting a symmetric position of the imbalance weights relative to moulding box 1.

As is indicated by arrows A and B, the imbalance weights 2 and 3 rotate in opposite directions in the embodiment according to FIGS. 1–6. Similarly, imbalance weights 4 and 5 of the embodiments shown in FIGS. 1–6 likewise rotate in opposite directions, as is indicated by means of arrows C and D.

Each of the imbalance weights 2–5 is driven by its own power source, for example an electric motor. The rotational speeds of the various imbalance weights can be adjusted independently of each other. The construction is thereby such that the number of revolutions per unit time of an imbalance weight can be briefly increased and/or decreased as desired during operation, independently of the speed at which the other imbalance weights are driven, for a purpose yet to be described in more detail.

Figure 1:
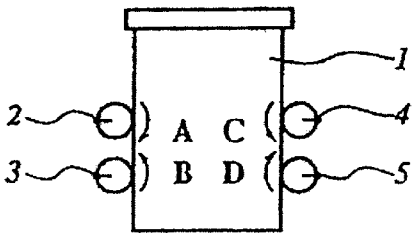

In the arrangement of the imbalance weights 2–5 which is shown in FIG. 1, the two imbalance weights 2 and 3 disposed one above the other are in phase with each other, and the same applies to the two imbalance weights 4 and 5 disposed one above the other, whilst imbalance weights 4 and 5 are shifted 180° with respect to imbalance weights 2 and 3.

If the imbalance weights arranged in this manner are rotated in the directions indicated by arrows A, B, C and D, the forces generated by the imbalance weights will be in equilibrium, so that no vibration force will be exerted on the moulding box.

This arrangement of the imbalance weights 2–5 will be used when the vibration is started and when the vibration is stopped, which makes it possible when accelerating or decelerating the imbalance weights to a desired speed to prevent a vibration force being exerted on the assembly of moulding box and on the means supporting the moulding box at a frequency which corresponds with the natural frequency of said assembly. The fact is that such an event might severely disturb the obtained compactness of the moulding sand, in particular during deceleration of the imbalance weights. In this arrangement of the imbalance weights, the moulding box may also be placed into and/or removed from a frame (as described hereafter) supporting the moulding box, without having to stop the motors driving the imbalance weights.

Figure 2:
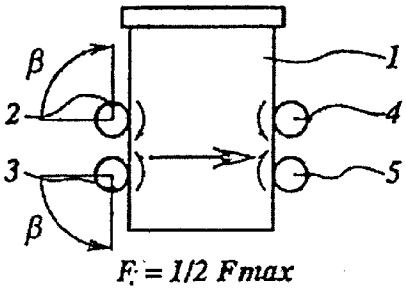

Starting from the position of imbalance weights 2–5 which is shown in FIG. 1, the rotating imbalance weights 2 and 3 can for example be shifted in opposite directions through and angle $\beta$ of 90° relative to each other, as shown in FIG. 2, so that imbalance weight 3 lags 180° in phase relative to imbalance weight 2. The counterweights 4 and 5 are thereby maintained in the relative positions as shown in FIG. 1.

When the imbalance weights arranged in this manner are rotating, the forces generated by imbalance weights 2 and 3 will offset each other, whilst the two rotating imbalance weights 4 and 5 will generate a force F=½Fmax.

Figure 3:
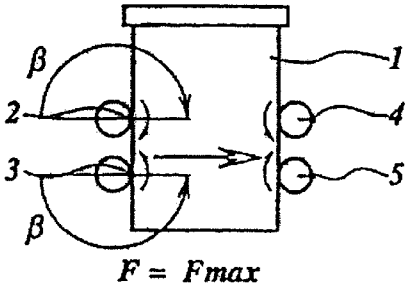

Another possible arrangement of the imbalance weights is shown in FIG. 3, wherein the rotating imbalance weights 2 and 3 are shifted through 180° relative to the position shown in FIG. 1, so that they are in phase with imbalance weights 4 and 5. When the imbalance weights arranged in this manner are rotating, the force generated in horizontal direction will be F=Fmax.

Figure 4:
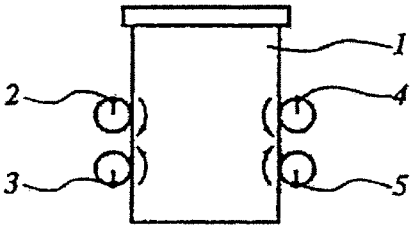

In the arrangement of the rotating imbalance weights which is shown in FIG. 4, imbalance weights 2 and 4, which are disposed one beside the other, are in phase with each other, whilst imbalance weights 3 and 5, which are likewise disposed one beside the other, being in phase with each other, are shifted in phase through 180° relative to imbalance weights 2 and 4. When the imbalance weights 2–5 arranged in this manner are rotating again in the direction of indicated by arrows A, B, C and D respectively, the forces generated by the rotating imbalance weights will offset each other, so that no vibration force will be exerted on moulding box 1.

Figure 5:
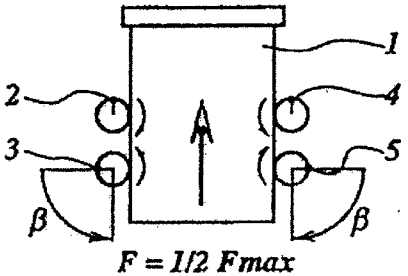

When, starting from the above-described arrangement as shown in FIG. 4, two imbalance weights disposed one beside the other, imbalance weights 3 and 5 in the embodiment of FIG. 5, are shifted in phase in opposite directions through an angle β of 90° relative to the arrangement as shown in FIG. 4, the forces generated by imbalance weights 3 and 5 will offset each another during rotation of the imbalance weights arranged in this manner, and the two imbalance weights 2 and 4 will generate a vertically oriented vibration force of a magnitude F=½Fmax.

Figure 6:
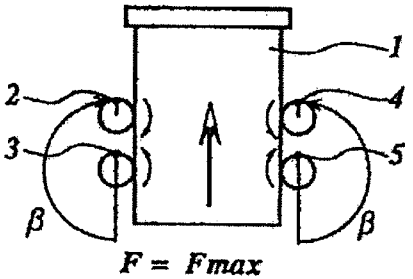

Another possibility is to shift the imbalance weights 3 and 5 from the position shown in FIG. 4 through an angle β of 180°, as is shown in FIG. 6, so that all imbalance weights will be in phase with each other. In this arrangement, the rotating imbalance weights will generate a vertically oriented vibration force F=Fmax.

It will be apparent that the above-described arrangement and configuration of the rotating imbalance weights during operation makes it possible to choose whether or not to subject moulding box 1 to a vibration force while the imbalance weights are rotating, whereby both the magnitude and the direction of the vibration force being exerted can be varied independently of the frequency of the vibration force at a constant rotational speed of the imbalance weights. The magnitude of the vibration force will depend on the rotational speed of the rotating imbalance weights, of course.

Figure 7:
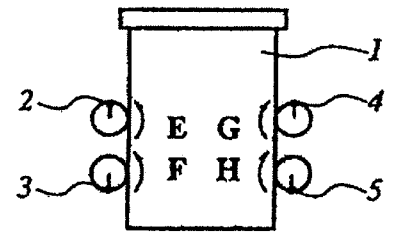
Figure 8:
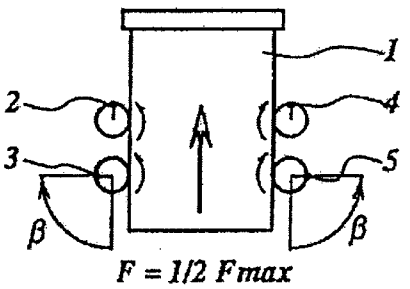
Figure 9:
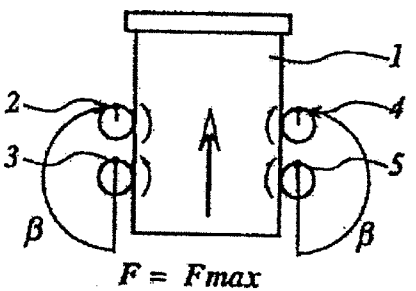

FIGS. 7–9 show an arrangement wherein the counterweights 2 and 3 disposed on one side of moulding box 1 rotate in the same direction, as indicated by arrows E and F, whilst the counterweights 4 and 5 disposed one above the other likewise rotate in one direction as indicated by arrows G and H, albeit in a direction opposed to the direction of rotation of imbalance weights 2 and 3.

In the arrangement which is shown in FIG. 7, the two imbalance weights 2 and 4 disposed on either side of moulding box 1 are in phase with each other, as are the two imbalance weights 3 and 5 disposed on either side of moulding box 1, whereby imbalance weights 3 and 5 are shifted in phase through 180° relative to imbalance weights 2 and 4, however. In this arrangement of the imbalance weights, the forces generated in the direction indicated by the arrows during rotation of the imbalance weights will offset each other, so that no vibration force will be exerted on moulding box 1, even though the imbalance weights are rotating.

Two imbalance weights disposed beside the other, the lower imbalance weights 3 and 5 in FIG. 8, can be shifted in phase in opposite directions through an angle β of 90° relative to each other from the position shown in FIG. 7. In this arrangement, the forces generated by rotating imbalance weights 3 and 5 will offset each other, whilst the rotating imbalance weights 2 and 4 will generate a vertical vibration force of a magnitude F=½Fmax.

According to another possibility, two imbalance weights disposed one beside the other, the lower imbalance weights 3 and 5 in FIG. 9, are shifted in phase through an angle β of 180° from the position shown in FIG. 7, so that all four imbalance weights 2–5 will be in phase with each other. In this arrangement of the imbalance weights, the imbalance weights will exert a vertically oriented vibration force F=Fmax on moulding box 1.

It will be apparent that also with the arrangement and direction of rotation of the imbalance weights as shown in FIGS. 7–9, the magnitude of the vibration force can be changed independently of the frequency of the vibration force, whilst also an arrangement wherein no vibration force at all is exerted on the moulding box during rotation of the imbalance weights in conceivable.

Figure 11:
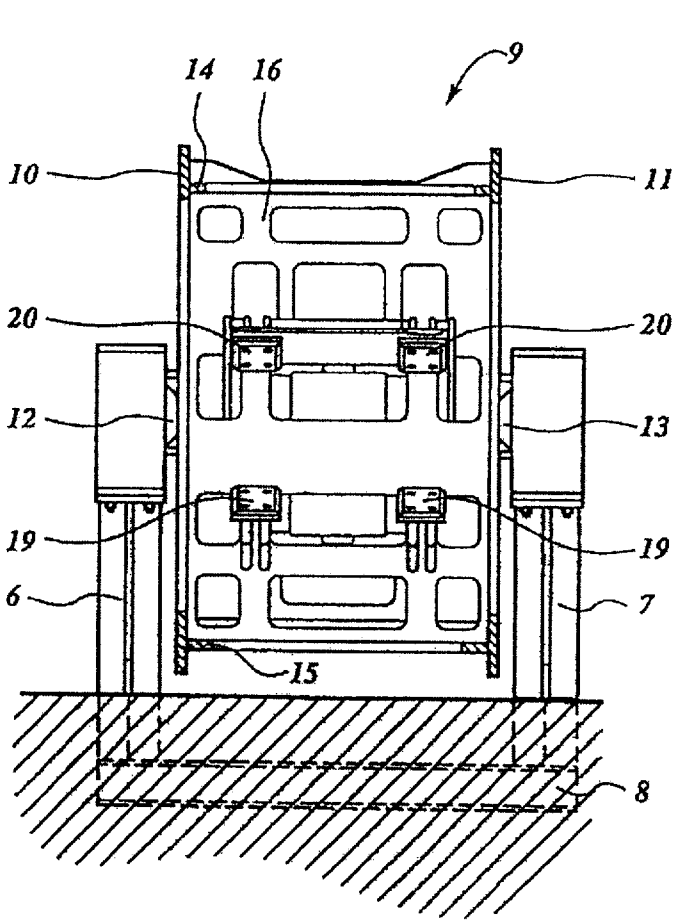
FIG. 11 is a sectional view of FIG. 10, seen along line XI—XI in FIG. 10.
Figure 10:
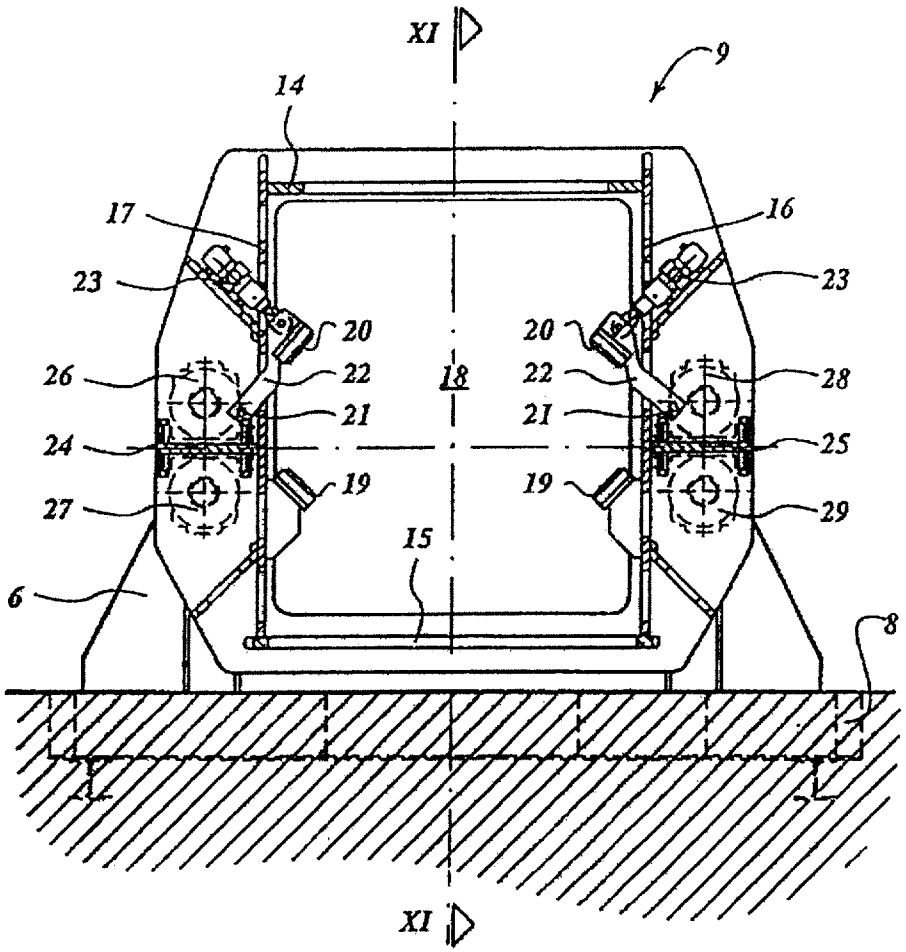
FIG. 10 is a diagrammatic sectional view of a device in which a moulding box can be clamped down, and by means of which the method according to the invention can be used.

FIGS. 10 and 11 diagrammatically show a device for carrying out the method. The device comprises two spaced-apart supports 6 and 7, which are attached to foundation beams 8 which are anchored in the ground.

Supports 6 and 7 support a supporting frame 9, which, as is shown in FIG. 10 as well as in FIG. 11, comprises a symmetrical construction with respect to a vertical center plane. Frame 9 thereby comprises two vertical and parallel frame-shaped side walls 10 and 11, which are spring-supported in supports 6 and 7 by means of supports 12 and 13 respectively.

The spaced-apart side walls 10 and 11 are interconnected by two frame-shaped connecting walls 14 and 15 disposed one above the other and extending in horizontal direction, seen in FIGS. 10 and 11, and by parallel cross walls 16 and 17, which are provided with a large number of holes.

The above walls thereby bound a space 18, in which a moulding box 1 containing a model and moulding sand can be arranged and vibrated. Supports 19, on which the moulding box can be placed, are attached to cross walls 16 and 17 for the purpose of supporting the moulding box.

Clamping elements 20 for clamping down the moulding box on supports 19 are furthermore provided some distance above supports 19, which clamping elements are mounted on the ends of levers 22, which can pivot about horizontal pins 21. Levers 22 can be pivoted by means of setting elements 23 of any desired form. It will be apparent that once a moulding box is present on supporting elements 19, the clamping elements 20 can be pressed against the moulding box by means of setting elements 23 so as to clamp the moulding box down firmly in space 18 of frame 9.

As is furthermore apparent, in particular from FIG. 10, horizontally extending supporting plates 24 and 25 are secured to the sides of cross walls 16 and 17 that face away from each other, on which supporting plates the motors 26–29 for driving the counterweights 2–5 (not shown), which are likewise supported by supporting plates 24, 25, are mounted. It is preferred to use electric motors, which can be controlled by means of a control unit which is known per se, in such a manner that a brief deceleration or acceleration of the rotating motors can be effected so as to shift the imbalance weights in the manner described above.

It will be apparent, that the moulding box and its contents, which is thus clamped down in frame 9, can be vibrated as desired in the above-described manner. Preferably, the construction of frame 9 and the arrangement of the imbalance weights are thereby such that the resulting vibration force generated by the imbalance weights passes at least substantially through the center of gravity of the filled moulding box.

What is claimed is:

1. A method for compacting molding sand in a molding box in which a model is embedded in molding sand, wherein said method comprises the steps of:

vibrating the molding box using a first imbalance weight, a second imbalance weight, a third imbalance weight, and a fourth imbalance weight wherein each imbalance weight is independently driven by a respective motor and is connected to the molding box, rotating each said imbalance weight about an axis of rotation during operation, and shifting each said imbalance weight independently in phase relative to each other during operation.

2. The method according to claim 1, wherein said step of vibrating the molding box further comprises the step of placing the molding box between each said imbalance weight such that said first and second imbalance weights are arranged symmetrically on a first side of the molding box and said third and fourth imbalance weights are arranged symmetrically on an opposing second side of the molding box, wherein all of the imbalance weights are substantially symmetrical about horizontal and vertical centerlines of the molding box.

3. The method according to claim 1 further comprising the steps of:

disposing said first and second imbalance weights on one side of said molding box; and rotating said first imbalance weight in a direction opposite said second imbalance weight during operation.

4. The method according to claim 1, further comprising the steps of:

disposing said first imbalance weight on a first side of the molding box above said second imbalance weight;

disposing said third imbalance weight on a second side of the molding box above said fourth imbalance weight; and rotating said first imbalance weight and said third imbalance weight in opposite directions.

5. The method according to claim 1, wherein said step of vibrating the molding box further comprises:

rotating said first imbalance weight in phase with said second imbalance weight, wherein said first and second imbalance weights are disposed on a first side of the molding box;

rotating said third imbalance weight in phase with said fourth imbalance weight, wherein said third and fourth imbalance weights are disposed on a second side of the molding box and are rotated out of phase in an opposite direction with respect to said first imbalance weight and said second imbalance weight.

6. The method according to claim 5, further comprising the step of shifting the phase of said second imbalance weight once the first imbalance weight and the second imbalance weight reach a specified rotational speed.

7. The method according to claim 1, wherein said step of vibrating the molding box further comprises:

disposed said first imbalance weight and said second imbalance weight on a first side of the molding box;

rotating said first imbalance weight in the same direction as said second imbalance weight;

disposing said third imbalance weight and said fourth imbalance weight on a second side of the molding box;

rotating said third imbalance weight in the same direction as said fourth imbalance weight, wherein the direction of rotation of the first and second imbalance weights is opposed to the direction of rotation of the third and fourth imbalance weights.

8. The method according to claim 7, further comprising the steps of:

rotating said first imbalance weight out of phase with said second imbalance weight; and rotating said third imbalance weight in phase with said fourth imbalance weight.

9. The method according to claim 8, further comprising the step of:

shifting the phase of rotation of said first imbalance weight and said second imbalance weight.

10. The method according to claim 9, further comprising the step of:

shifting the phase of rotation of said third imbalance weight and said fourth imbalance weight.

11. The method according to claim 1, wherein said step of vibrating the molding box further comprises:

positioning each imbalance weight relative to the molding box such that a resulting vibration force generated by a combination of motors passes at least substantially through the center of gravity of the molding box.

12. A device for compacting molding sand in a molding box in which a model is present, which model is embedding in molding sand, wherein said device comprises:

a frame for supporting said molding box;

at least four imbalance weights connected to said frame, wherein said frame supports said four imbalance weights and wherein said imbalance weights are independently rotatable about axes of rotation extending parallel to each other; and at least four variably driven dynamic motor means that drive respective imbalance weights and shift them in phase relative to each other.

13. The device according to claim 12, wherein said frame comprises a box-shaped supporting frame, wherein said molding box can be supported inside said frame.

14. The device according to claim 13, wherein said supporting frame comprises two walls extending parallel to each other, which walls bound the space in which the molding box can be disposed, wherein said imbalance weights and said motors driving said imbalance weights are mounted on the sides of said walls that face away from each other.

15. The device according to claim 12, wherein the frame comprising the imbalance weights connected thereto is of symmetrical construction.

16. A method for compacting molding sand in a molding box in which a model is present, wherein said method comprises the steps of:

providing a first imbalance weight, a second imbalance weight, a third imbalance weight, and a fourth imbalance weight wherein each imbalance weight is independently driven by a respective motor and is connected to the molding box;

rotating each said imbalance weight about an axis of rotation;

shifting at least one imbalance weight relative to each other imbalance weight while each said imbalance weight is rotating; and vibrating the molding box.

17. The method as described in claim 16 further comprising the steps of:

positioning said first and second imbalance weights on one side of the molding box; and rotating said first imbalance weight in a direction opposite said second imbalance weight.

18. The method as described in claim 16 further comprising the steps of:

positioning said first imbalance weight and said second imbalance weight on a first side of the molding box, wherein said first imbalance weight is above said second imbalance weight;

positioning said third imbalance weight and said fourth imbalance weight on a second side of the molding box, wherein said third imbalance weight is above said fourth imbalance weight; and rotating said first imbalance weight and said third imbalance weight in opposite directions.

19. The method as described in claim 16 wherein the step of vibrating the molding box further comprises:

rotating said first imbalance weight in phase with said second imbalance weight, wherein said first imbalance weight and said second imbalance weight are proximate a first side of the molding box; and rotating said third imbalance weight in phase with said fourth imbalance weight, wherein said third imbalance weight and said fourth imbalance weight are proximate a second side of the molding box, and wherein said third imbalance weight is substantially 180 degrees out of phase with respect to said first imbalance weight.

20. The method as described in claim 16 further comprising the step of shifting the phase of said first imbalance weight and said second imbalance weight once the first imbalance weight and the second imbalance weight obtain a predetermined rotational speed.

21. The method as described in claim 16 wherein said step of vibrating the molding box further comprises:

positioning said first imbalance weight and said second imbalance weight on a first side of the molding box;

rotating said first imbalance weight in the same direction as said second imbalance weight;

positioning said third imbalance weight and said fourth imbalance weight on a second side of the molding box;

rotating said third imbalance weight and said fourth imbalance weight in a direction opposite to said first imbalance weight and said second imbalance weight.

22. The method as described in claim 21 further comprising the steps of:

rotating said first imbalance weight out of phase with said second imbalance weight; and rotating said third imbalance weight in phase with said fourth imbalance weight.

23. The method as described in claim 22 further comprising the step of:

shifting the phase of rotation of said first imbalance weight and said second imbalance weight.

24. The method as described in claim 16 wherein the step of vibrating the molding box further comprises:

positioning each imbalance weight relative to the molding box such that a resulting vibration force passes at least substantially through the center of gravity of the molding box.

* * * * *